US005176251A

United States Patent [19]

Davis et al.

[11] Patent Number: 5,176,251

[45] Date of Patent: Jan. 5, 1993

[54] CONTROLLING MOISTURE LOSS OR GAIN IN PLASTIC PACKAGES

[75] Inventors: Kent A. Davis, Travelers Rest; C. Michael Lulham, Gray Court; Walter B. Mueller, Inman, all of S.C.

[73] Assignee: W. R. Grace & Co.-Conn., Duncan, S.C.

[21] Appl. No.: 696,458

[22] Filed: May 6, 1991

[51] Int. Cl.[5] ..... B65D 81/24; B65D 30/22; B65D 30/08

[52] U.S. Cl. ..... 206/205; 383/38; 383/113; 53/434; 53/449

[58] Field of Search ..... 383/113, 110, 37, 38; 206/484, 484.1, 484.2, 524.3, 524.4, 524.9, 205; 53/434, 449

[56] References Cited

U.S. PATENT DOCUMENTS

| | | | |
|---|---|---|---|
| 2,721,691 | 10/1955 | Makrauer | 383/111 |
| 2,785,720 | 3/1957 | Wikle | 383/113 |
| 4,172,152 | 10/1979 | Carlisle | 383/110 |
| 4,179,027 | 12/1979 | Weisberg | 206/205 |
| 4,597,765 | 7/1986 | Klatt | 206/205 X |
| 4,874,094 | 10/1989 | Blanke, Jr. | 383/110 |

FOREIGN PATENT DOCUMENTS

| | | | |
|---|---|---|---|
| 085534 | 8/1983 | European Pat. Off. | 383/110 |

*Primary Examiner*—William I. Price

*Attorney, Agent, or Firm*—William D. Lee, Jr.; Jennifer L. Skord; Mark B. Quatt

[57] ABSTRACT

The invention is a package comprising an outer plastic container, an inner plastic container, a product within the inner container, a liquid located in a space defined by the outer and inner containers, and a separating device located in said space.

3 Claims, 3 Drawing Sheets

CONTROLLING MOISTURE LOSS OR GAIN IN PLASTIC PACKAGES

FIELD OF THE INVENTION

The present invention relates to plastic materials, and more preferably to plastic materials useful in flexible and semi-rigid packaging applications.

BACKGROUND OF THE INVENTION

Certain products, especially medical products such as blood collection wet sets, are currently packaged in a foil "overpouch". A transparent alternative to the foil would be desirable, but typical commercially available transparent thermoplastic packaging films do not have sufficiently low moisture vapor transmission rates (MVTR) for such applications.

The present invention solves this problem by providing a package which is transparent, yet has low MVTR.

SUMMARY OF THE INVENTION

The invention is a package comprising an outer plastic sealed container, an inner plastic sealed container, a product within the inner container, a liquid located in a space defined by the outer and inner containers, and a separating medium located in said space.

The invention also comprises a method of making a package comprising placing a product in a first plastic container; sealing the first container; placing the first sealed container, with the product therein, in a second container; placing a separating medium in the space defined by the first and second containers; introducing a liquid in the space defined by the first and second containers; and sealing the second container.

BRIEF DESCRIPTION OF THE DRAWINGS

The invention may be further understood by reference to the drawings, wherein.

DESCRIPTION OF THE PREFERRED EMBODIMENTS

Figure 1:
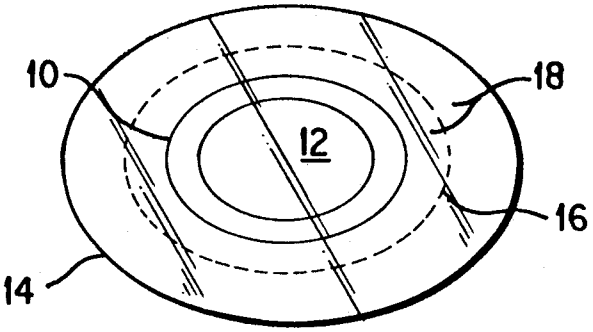
FIG. 1 is a schematic diagram of a package of the invention.
Figure 2:
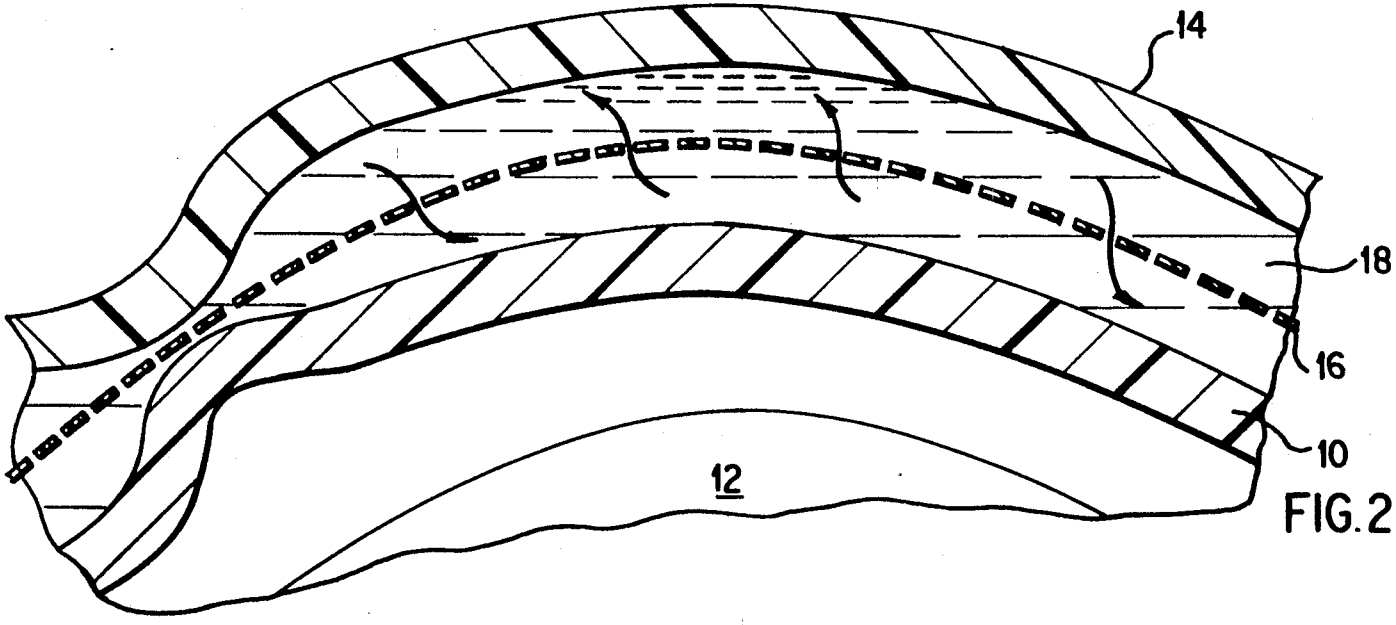
FIG. 2 is an enlargement of a portion of FIG. 1.
Figure 3:
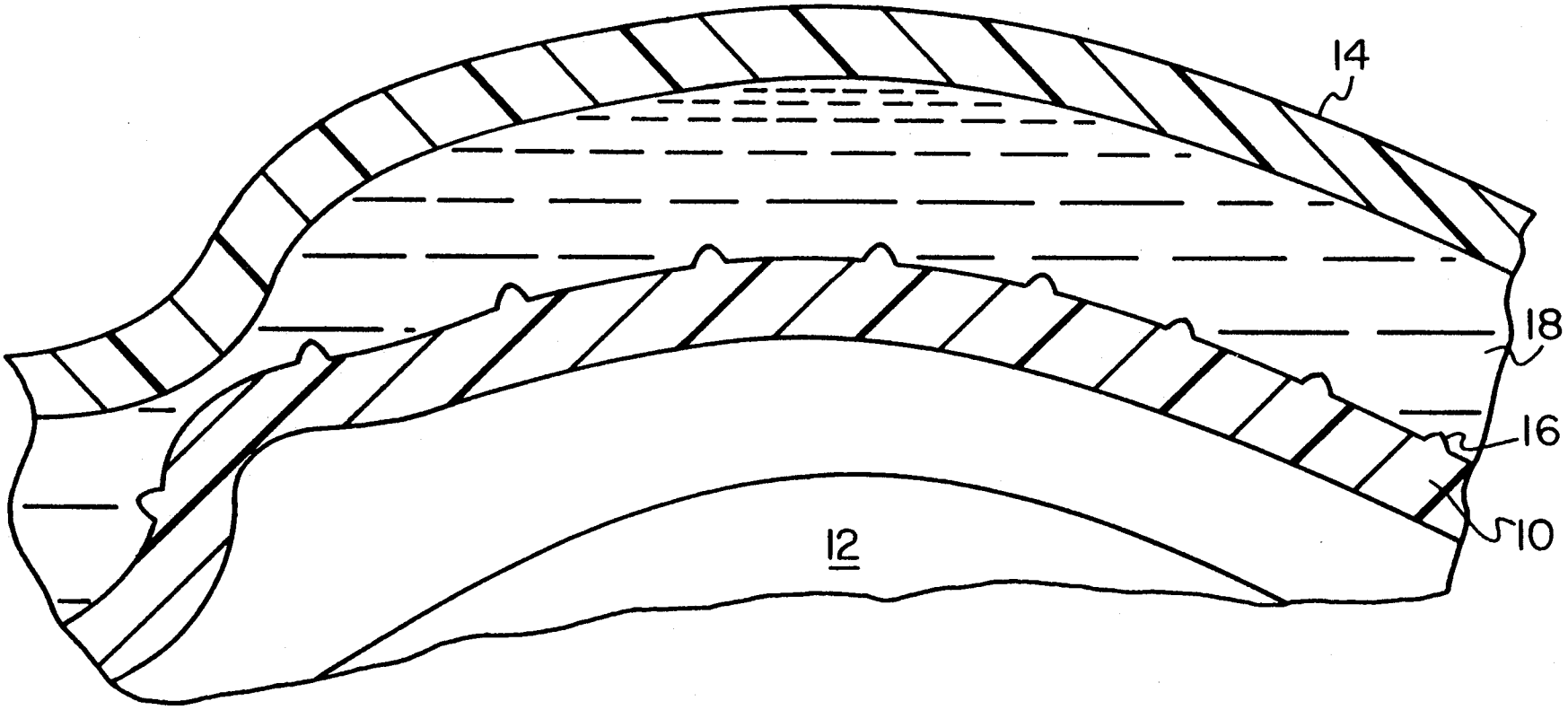
FIG. 3 is an enlargement of an alternative embodiment of a portion of FIG. 1 showing a textured inner container.
Figure 4:
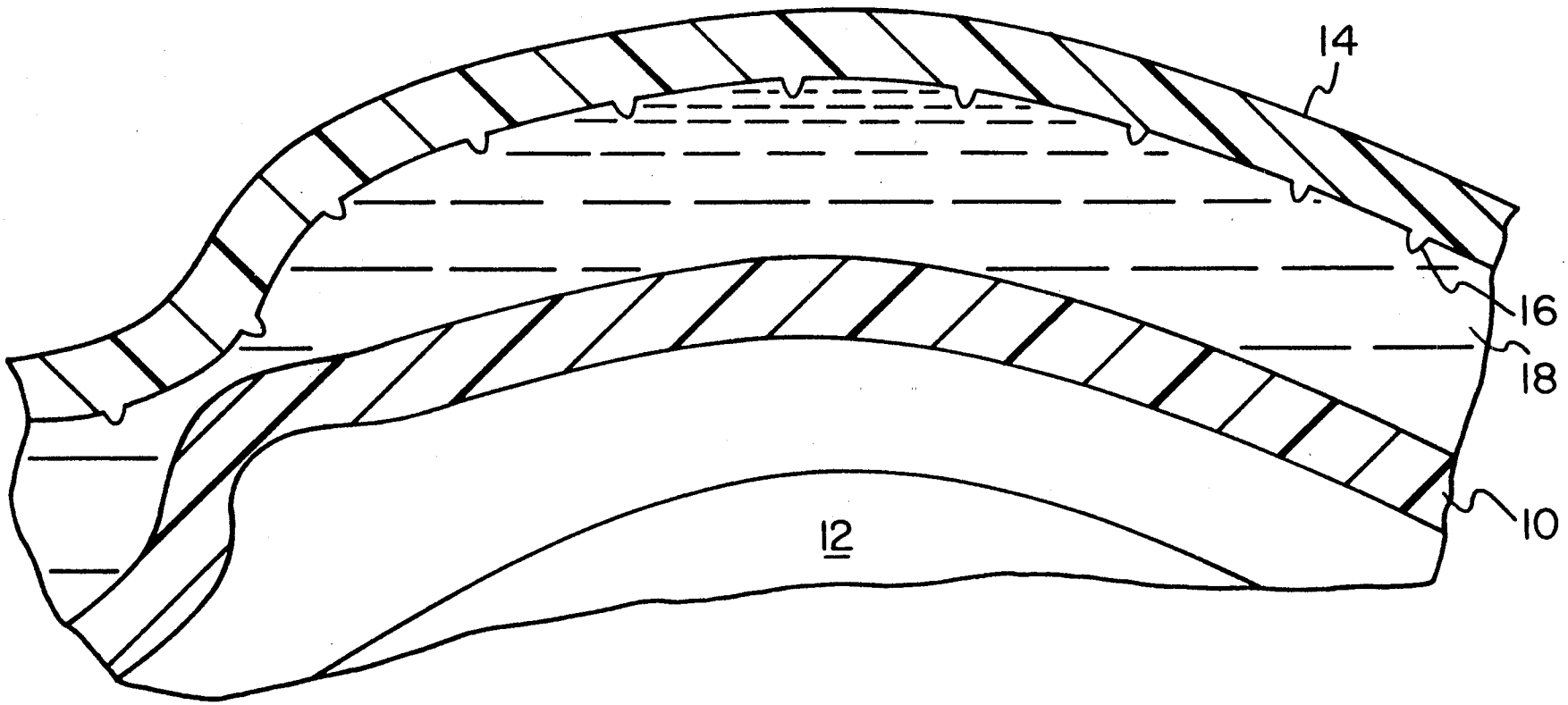
FIG. 4 is an enlargement of an alternative embodiment of a portion of FIG. 1 showing a textured secondary container.

Referring to FIG. 1, a primary container 10 containing a solution or a wet product 12 is packaged within a second, outer container 14.

A separating material 16 is first placed between the primary and outer containers, and then water or a liquid solution 18, hereinafter called the intermediate solution, is introduced between the primary and outer containers prior to sealing the outer container.

The presence of moisture between the primary and outer containers increases the relative humidity (RH) in that space. This reduces the moisture concentration difference from the inside to outside of the primary container. The resulting reduction of the moisture gradient across the primary container (which is the "driving force" of moisture vapor transmission) reduces moisture vapor permeation across the primary container.

If required, the tonicity of the intermediate solution can be adjusted to approximate the tonicity of the contents in the primary container, thus minimizing the difference in the solution concentration. For example, this might be desirable if the primary container contains a concentrated salt solution. In such a case, adjusting the intermediate solution to approximate the same concentration would prevent water from migrating into the primary container (from osmotic pressure resulting from the concentration gradient during e.g. an autoclave cycle).

The separating medium prevents intimate contact between the primary and outer container, such as would normally happen due to package weight. This contact would squeeze out the intermediate solution from between the primary and outer container, effectively allowing them to act as a single material. The driving force would then become the difference between the internal RH of the primary container and the ambient RH of the atmosphere outside the outer container. Thus, although the invention can be practiced without the separating medium, it is preferable to use the separating medium to insure the intermediate solution is present throughout the space defined by the primary and outer containers (excepting of course the space occupied by the separating medium itself).

The separating medium can be of various materials and form. Ideally, it should be inert to water over extended storage, able to withstand sterilization procedures if required, low in cost and weight and non abrasive. The points of actual contact between the separating material and the inner or outer package should be minimized so that a maximum amount of surface area of the primary container is exposed to the intermediate solution.

An example of a suitable separating material would be polypropylene netting. Other materials may also work well, including water absorbing gels.

The separating medium could be incorporated as part of the primary container or outer container, such as through lamination or coextrusion.

This invention allows the use of plastic packaging materials, even including those having relatively high MVTR, for high performance moisture barrier packages. This allows the use of flexible plastics for applications which currently require metal, foils or glass.

There is an alternative to use of a discrete separating medium, or a separating medium incorporated as a part of the primary or outer container. In this alternative, the outer surface of the primary and/or inner surface of the outer containers (i.e. the surfaces which define the space between the containers) can be textured, formed, or otherwise modified to prevent the intimate contact of these respective containers. "Separating medium" is used herein to mean any of these alternatives, although a discrete medium as previously described is preferred.

The hermetically sealed primary and secondary containers can be made from a variety of flexible or rigid plastics using existing technology (form/fill/seal, bags, pouches, thermoform/fill/seal, etc.). For best results, the materials should be formulated to minimize MVTR, particularly the outer container.

The separating medium between the containers can also be made from a wide variety of materials and can also be of various formats.

EXAMPLES

Plastic netting made from polypropylene (PP), high density polyethylene, (HDPE), etc.

Uncoated Tyvek (spun bonded polyolefin) Water absorbing gels/polymers

The separating medium may be a separate constituent or it may be incorporated onto the outside surface of the primary container or inside surface of the secondary container using a number of methods such as, but not limited to, a thermal or corona bonded lamination.

It is also possible that either the outer surface of the primary container and/or inner surface of the outer container could be textured by a calendaring or extrusion process to achieve adequate separation of the two containers.

What is claimed is:

1. A package comprising:

a) an outer plastic sealed container;

b) an inner plastic sealed container;

c) a product within the inner container;

d) a liquid located in a space defined by the outer and inner containers; and e) a separating medium located in said space, which prevents intimate contact between the inner and outer containers.

2. A package comprising:

a) an outer plastic sealed container;

b) an inner plastic sealed container;

c) a product within the inner container; and d) a liquid located in a space defined by the outer and inner containers;

wherein an outer surface of the inner plastic sealed container is textured to prevent intimate contact between the inner and outer containers.

3. A package comprising:

a) an outer plastic sealed container;

b) an inner plastic sealed container;

c) a product within the inner container; and d) a liquid located in a space defined by the outer and inner containers;

wherein an inner surface of the outer plastic sealed container is textured to prevent intimate contact between the inner and outer containers.

* * * * *